US005236034A

United States Patent [19]

Cestaro et al.

[11] Patent Number: 5,236,034

[45] Date of Patent: Aug. 17, 1993

[54] WEB REINFORCED EXPENDABLE CORE

[75] Inventors: John P. Cestaro, Sanibel Island, Fla.; Robert E. Downing, Toledo, Ohio

[73] Assignee: Doehler-Jarvis Limited Partnership, Toledo, Ohio

[21] Appl. No.: 851,642

[22] Filed: Mar. 16, 1992

[51] Int. Cl.[5] ..... B22C 9/10; B22C 9/24

[52] U.S. Cl. ..... 164/369; 164/370; 164/367

[58] Field of Search ..... 164/369, 370, 340, 365, 164/366, 367

[56] References Cited

U.S. PATENT DOCUMENTS

| | | | |
|---|---|---|---|
| 3,374,827 | 3/1968 | Schebler | 164/397 |
| 4,273,182 | 6/1981 | Winterhalter et al. | 164/137 |
| 4,614,219 | 9/1986 | Anderson et al. | 164/369 |
| 4,917,169 | 4/1990 | Melde-Tuczai et al. | 164/369 |
| 4,942,917 | 7/1990 | Koch et al. | 164/369 |

FOREIGN PATENT DOCUMENTS

| | | | |
|---|---|---|---|
| 0232654 | 12/1984 | Japan | 164/340 |
| 62-240459 | 3/1989 | Japan . | |
| 0037955 | 2/1990 | Japan | 164/340 |
| 2046948 | 2/1990 | Japan | 164/340 |

*Primary Examiner*—Richard K. Seidel
*Assistant Examiner*—Erik R. Puknys
*Attorney, Agent, or Firm*—Hugh Adam Kirk

[57] ABSTRACT

This disclosure concerns an expendable core for molds such as die casting dies, which core has a central aperture which may be elongated. The outside of this core is provided with a plurality of parallel grooves across the elongated sides of the core parallel to the aperture. These grooves may have corresponding ribs in the central aperture. One and the common end of each of these grooves is provided with a bridging web integral with the core for reinforcing and strengthening the core. The opposite end of the core from these webs may be provided with a printout portion also integral with the core by which the core is supported in the mold or die.

9 Claims, 5 Drawing Sheets

WEB REINFORCED EXPENDABLE CORE

BACKGROUND OF THE INVENTION

This invention is an improvement on the core in Koch et al U.S. Pat. No. 4,942,917 issued Jul. 24, 1990 and now assigned to the same assignee as this application (see Reel 5456, Frame 0880-application Ser. No. 07/378,317 filed Jul. 11, 1989) recorded in the United States Patent and Trademark Office.

SUMMARY OF THE INVENTION

Generally speaking, this invention deals with expendable cores for die casting dies, which cores have relatively large central apertures which extend through the core, causing the walls of the core to be relatively thin with respect to the size of the core. If the core is relatively elongated and so is its central aperture, the parallel spaced sides of the core need reinforcing, particularly if the sides are provided with grooves which may have corresponding ribs inside the aperture of the core. These grooves, and ribs, are substantially parallel to each other and to the walls of the aperture.

The improvement of this invention comprises reinforcing these cores by providing integral webs bridging one and the same end of each of the grooves. If desired, the other end or side of the core may be provided with integral printout portion for better supporting the core in the die. A specific use of this reinforced centrally hollow core is for forming a water jacket around a plurality of cylinders in a mold for die casting an engine block.

OBJECTS AND ADVANTAGES

It is an object of this invention to produce a simple, efficient, effective, economic and strong hollow expendable core for a mold or die of a die casting machine.

Another object is to produce an elongated apertured expendable core which is resistant to the shock of molten metal under high pressures in a mold.

Another object is to produce an expendable core for a die casting die which is reinforced to maintain its position in the die, thus producing more accurate castings from the die.

Still another object is to produce cavities in metal castings which lighten the weight of the casting by increasing the cavity in places where the weight of the casting may be decreased without decreasing the strength of the casting.

BRIEF DESCRIPTION OF THE VIEWS

The above mentioned and other features, objects and advantages and a manner of attaining them are described more specifically below by reference to embodiments of this invention shown in the accompanying drawings, wherein.

DETAILED DESCRIPTION OF PREFERRED EMBODIMENTS

Figure 1:
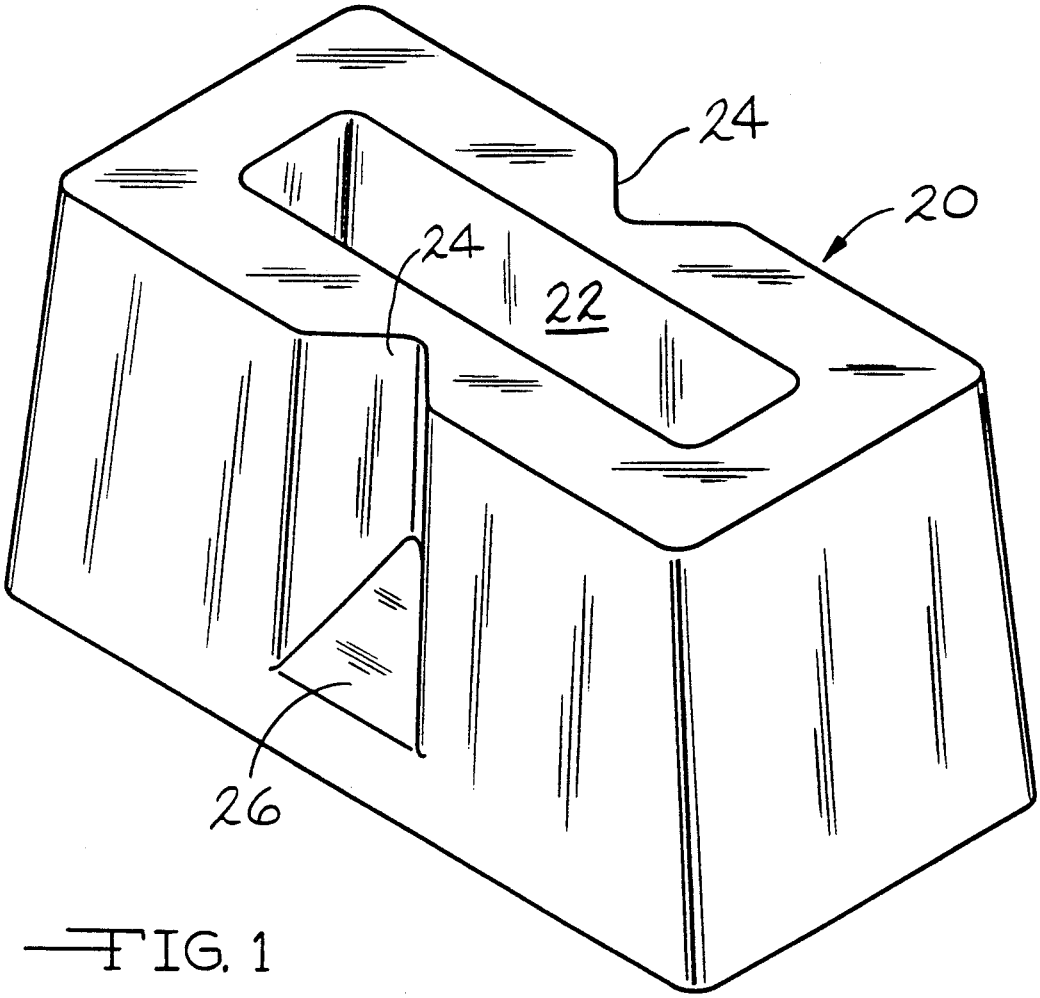
FIG. 1 is a perspective view of one embodiment of a core according to this invention.
Figure 2:
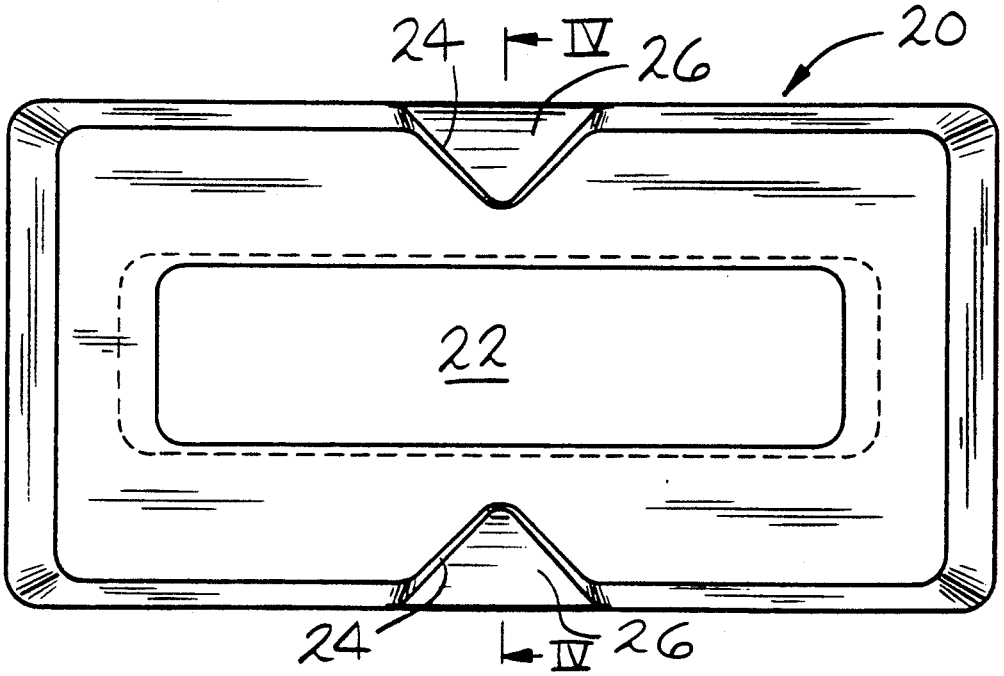
FIG. 2 is a top view of the core shown in FIG. 1.
Figure 3:
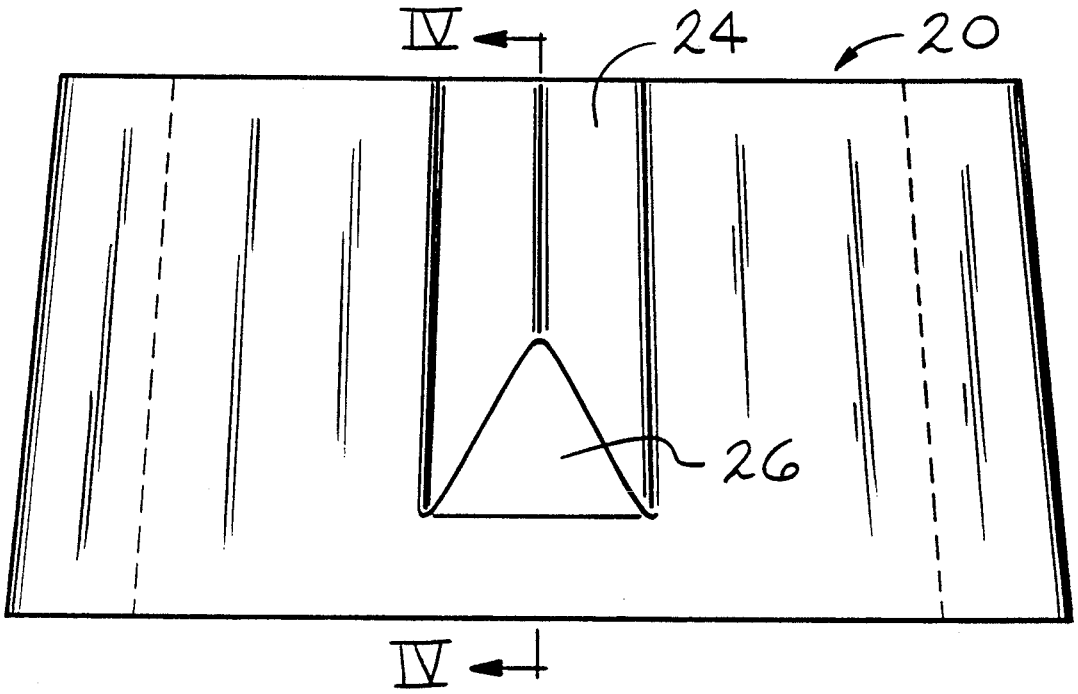
FIG. 3 is a side elevational view of the core shown in FIGS. 1 and 2.
Figure 4:
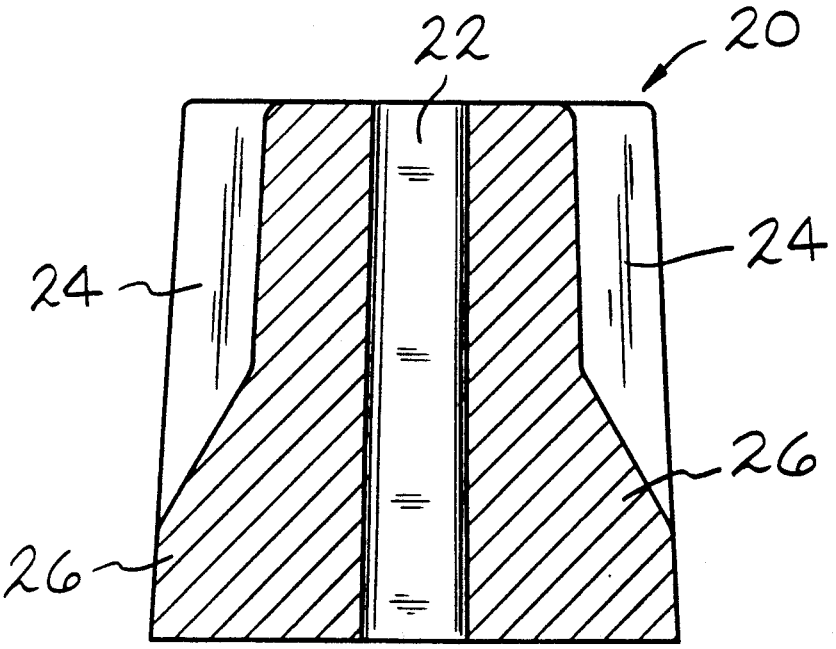
FIG. 4 is a vertical sectional view taken along lines IV—IV of FIGS. 2 and 3.

Referring first to the embodiment in FIGS. 1 through 4, there is shown an elongated frusto-rectangular pyramidal-shaped expendable core 20 having a through central aperture 22. Along the middle of opposite longer parallel sides of this core 20 are provided parallel grooves 24 parallel to the aperture. One and the same end of each groove 24 is bridged by an integral web portion 26 for strengthening the core, particularly along its longer unsupported sides, so that it can more easily resist the shock of injection of molten metal into the mold, particularly under high pressure in a die casting die.

Figure 5:
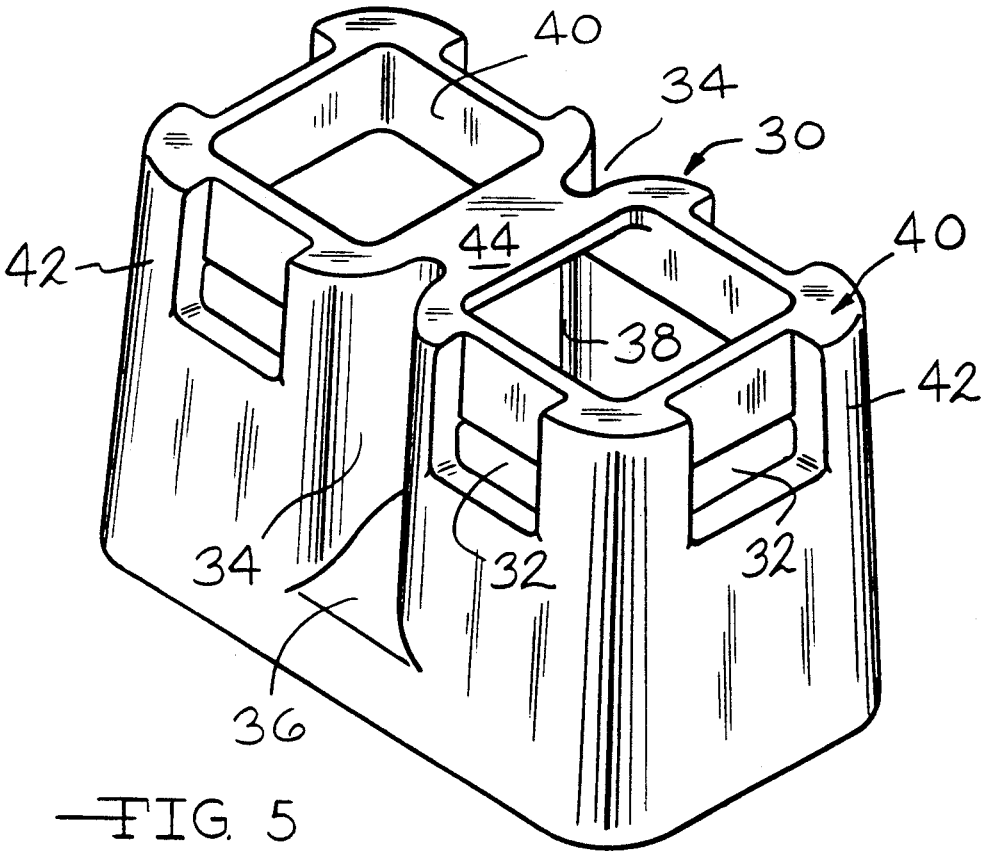
FIG. 5 is a perspective view of an expendable core having another configuration from that of FIGS. 1 through 4, including a printout portion at the top thereof.
Figure 6:
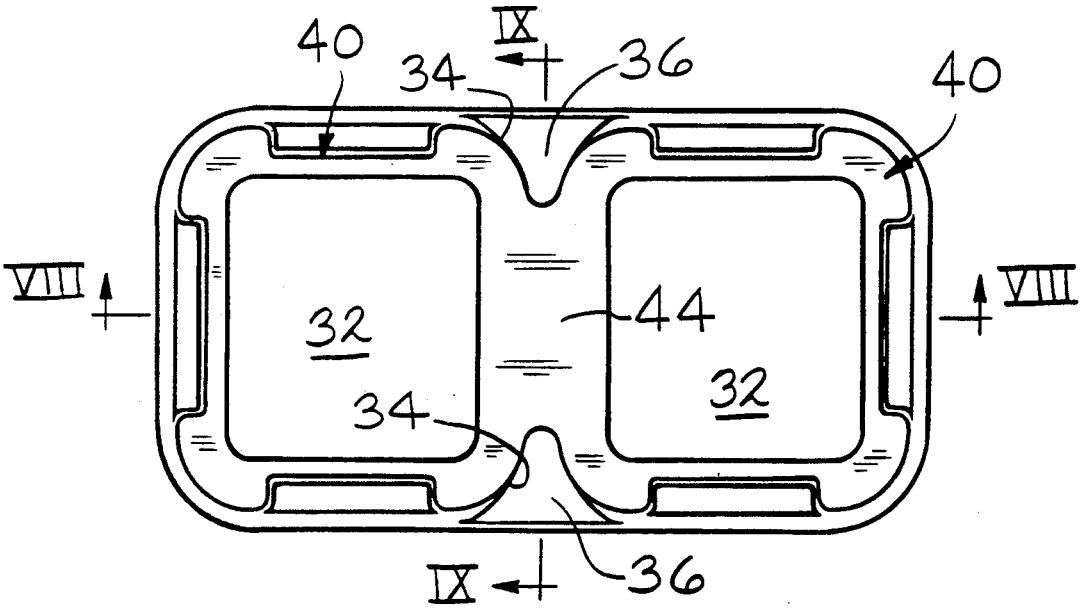
FIG. 6 is a top plan view of the core shown in FIG. 5.
Figure 7:
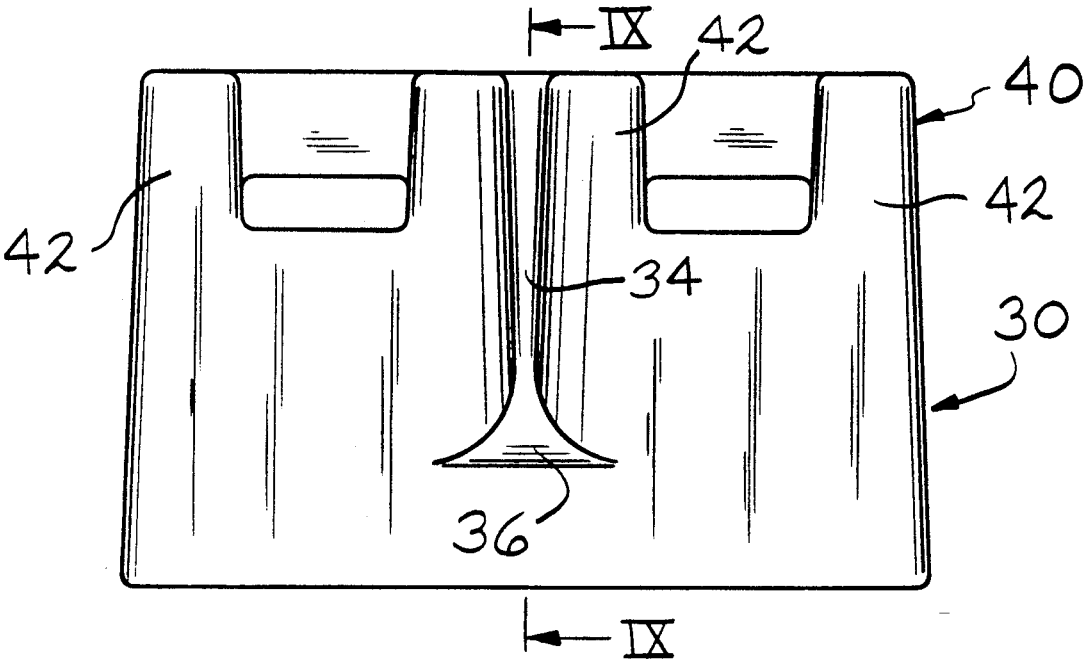
FIG. 7 is a side elevational view of the core shown in FIGS. 5 and 6.
Figure 8:
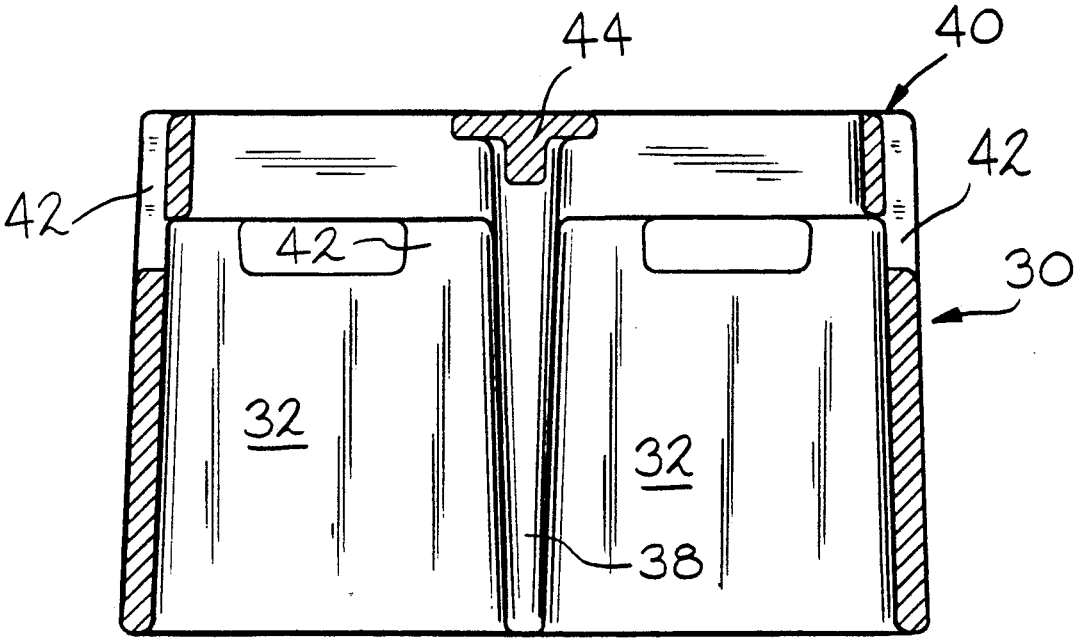
FIG. 8 is a sectional view taken along line VIII—VIII of FIG. 6.
Figure 9:
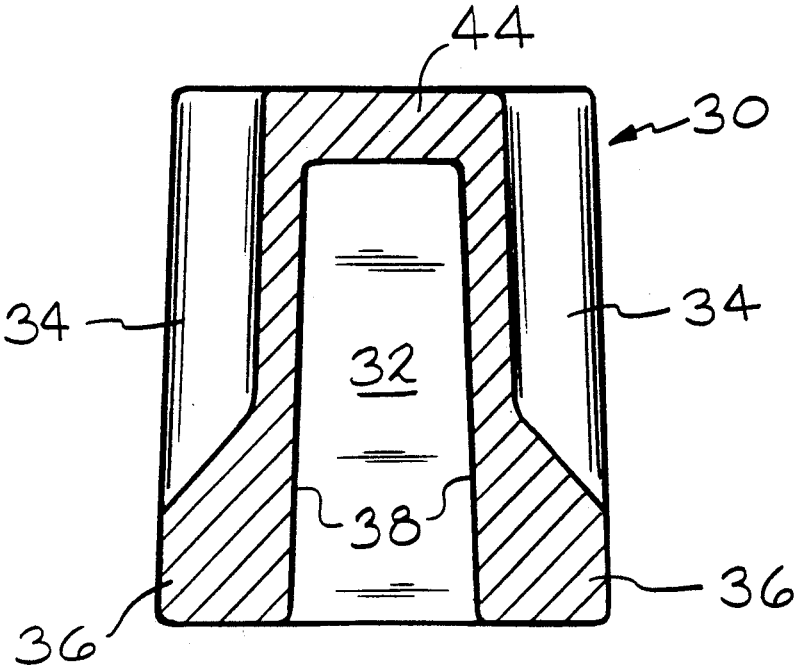
FIG. 9 is a sectional view taken along lines IX—IX of FIGS. 6 and 7.
Figure 10:
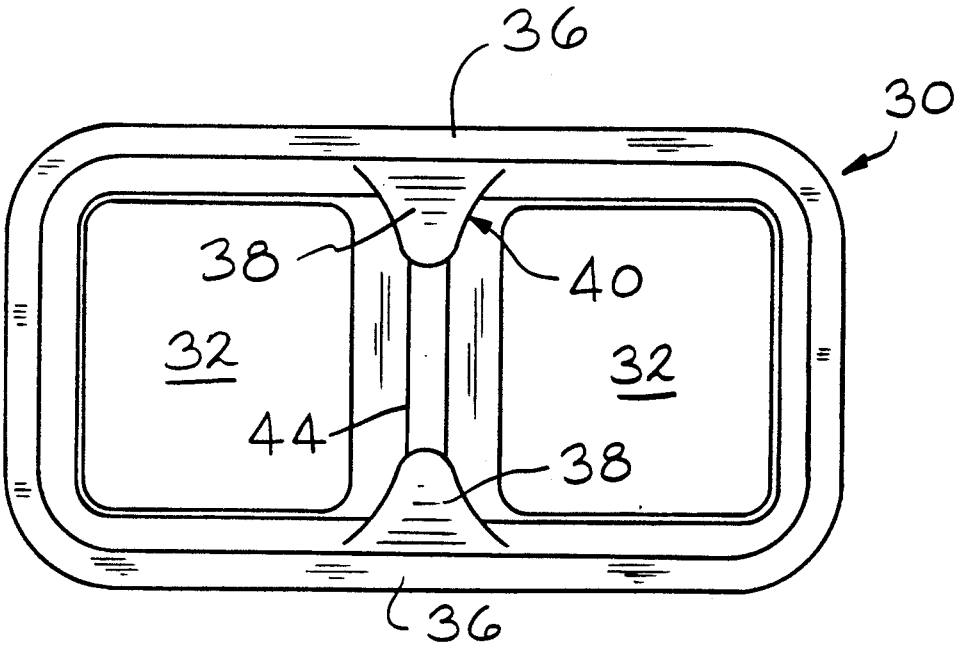
FIG. 10 is a bottom view of the core shown in FIGS. 5, 6, 7 and 8.

Referring now to the embodiment in FIGS. 5 through 10, there is shown an expendable core 30 with an integral printout portion 40 around one side of or top of the core 30. This printout 40 comprises herein a frame portion integrally connected to the core 30 by legs 42. This printout portion also has a bridging portion 44 between and centrally of the longer sides of the aperture 32. This integral printout member 44 strengthens at least the upper end of the core 30. In addition to the printout member 40 the opposite longer sides of the core are provided with grooves 34. At the lower end of each of these grooves 34 remote from the printout portion 40 is an integral web portion 36. This web 36 further strengthens the core 30 at the lower and outwardly suspended end of the core 30. This expendable core 30 is supported by the printout 40 in the die of a die casting mold. Furthermore, in this embodiment the grooves 36 are herein shown sufficiently deep to form ribs 38 inside the central aperture 32. These ribs 38 are also parallel to the grooves 34 and to the sides of the aperture 32. Herein the functions of the webs 36 is similar to that of the webs 26 disclosed in FIGS. 1 through 4.

The stiffening of the longer sides of the cores 20 and 30 resists deformation of these cores, thus providing more accurate castings made in the die with such cores. Furthermore, the webs 26 and 36 increase the size of the cores, and correspondingly decrease the amount of metal which is needed for the castings in which they are used. These webs 26 and 36 are preferably located in places where excess of metal may be undesirable, such as increasing the weight and/or porosity of the casting. Thus the additional webs 26 and 36 produce lighter weight castings by reducing the amount of metal needed for the die containing the cores of this invention. In turn this enables thinner and denser walls in the resulting casting.

While there is described above the principles of this invention in connection with specific apparatus, it is to be clearly understood that this description is made only by way of example and not as a limitation to the scope of this invention.

What is claimed is:

1. A hollow expendable core for molds for metal casting, said core having a supported side and an opposite unsupported side and a grooved surface extending at least halfway between said sides, the improvement comprising: providing a reinforcing web across a part of said groove away from said supported side for reinforcing said core and reducing the weight of a resulting casting.

2. A core according to claim 1 wherein said grooves are on the exterior of said core.

3. A core according to claim 1 including a printout for supporting said supported side, said printout being integral with the core and spaced away from said web.

4. A core according to claim 1 wherein said web is integral with said core.

5. A mold assembly having a core and means in said mold for supporting said core, said core having a supported side and an opposite unsupported side and a grooved surface extending at least halfway between said sides, the improvement comprising: providing a reinforcing web across a part of the said groove away from said supported side for reinforcing said core and reducing the weight of a resulting casting.

6. An expendable core having one end and an opposite end and an elongated hollow portion supported only at one end and having transverse parallel grooves along its outer elongated sides, said grooves extending at least halfway between said ends and the other end of said core being bridged by an integral web to reinforce and strengthen said core.

7. A core according to claim 6 including a printout integral with the core spaced from said web.

8. In a core having an elongated aperture held in a mold by a printout projecting beyond an end of said aperture, said core having at least one groove parallel to the sides of said aperture and extending at least halfway along the outside of the elongated side of said core, the improvement comprising an integral reinforcing web across the end of said groove remote from said printout, whereby said web thickens and strengthens the core away from said printout to withstand better the pressure and shock of molten metal as well as to form a more accurate casting because of the increased rigidity of the core in the mold.

9. An expendable sand core for a jacket around a plurality of cylinders in an engine block, said core comprising:

A) a printout projecting from one end of said core for supporting said core in a mold and said core having an opposite unsupported end, B) a plurality of grooves in the outside of said core between adjacent cylinders and extending at least halfway between said ends, and C) webs integral with said core bridging each of said grooves at a location remote from said printout adjacent said unsupported end of said core in a mold, whereby said unsupported end of said core is thickened and strengthened to withstand better the pressure and shock of molten metal when it is injected into said mold and also to form a more accurate casting because of the increased rigidity of said core.

* * * * *